United States Patent [19]

Johnson

[11] Patent Number: 4,946,982

[45] Date of Patent: Aug. 7, 1990

[54] FUEL COMPOSITION

[75] Inventor: Thomas H. Johnson, Houston, Tex.

[73] Assignee: Shell Oil Company, Houston, Tex.

[21] Appl. No.: 325,801

[22] Filed: Mar. 20, 1989

Related U.S. Application Data

[62] Division of Ser. No. 225,997, Jul. 29, 1988.

[51] Int. Cl.[5] ..... C07C 257/00

[52] U.S. Cl. ..... 560/158; 560/155; 560/157; 44/71

[58] Field of Search ..... 44/71; 560/155, 157, 560/158

[56] References Cited

U.S. PATENT DOCUMENTS

| | | | |
|---|---|---|---|
| 3,996,024 | 12/1976 | Coon | 44/71 |
| 4,105,417 | 8/1978 | Coon et al. | 44/63 |
| 4,138,370 | 2/1979 | Elliott et al. | 252/51.5 |
| 4,155,718 | 5/1979 | Graiff | 44/58 |
| 4,191,537 | 3/1980 | Lewis et al. | 44/71 |
| 4,197,409 | 4/1980 | Lilburn | 560/158 |
| 4,234,321 | 11/1980 | Lilburn | 44/72 |
| 4,247,301 | 1/1981 | Honnen | 44/63 |
| 4,270,930 | 6/1981 | Campbell et al. | 44/71 |
| 4,357,148 | 11/1982 | Graiff | 44/62 |
| 4,510,063 | 4/1985 | Chou et al. | 252/51.5 |
| 4,525,174 | 6/1985 | Croudace | 44/68 |
| 4,584,117 | 4/1986 | Wollenberg | 252/51.5 |
| 4,612,132 | 9/1986 | Wollenberg et al. | 252/51.5 |
| 4,624,681 | 11/1986 | Wollenberg | 44/63 |
| 4,659,491 | 10/1987 | Valkovich | 252/49.6 |
| 4,702,851 | 10/1987 | Wollenberg | 252/49.6 |
| 4,728,340 | 3/1988 | Vos | 44/62 |

FOREIGN PATENT DOCUMENTS

| | | |
|---|---|---|
| 3030014 | 2/1982 | German Democratic Rep. . |
| 8703603 | 6/1987 | World Int. Prop. O. . |

*Primary Examiner*—William R. Dixon, Jr.
*Assistant Examiner*—James M. Hunter, Jr.

[57] ABSTRACT

Certain poly(olefin)-N-substituted carbamates are useful to prevent or reduce engine deposits alone or in combination with certain poly(olefin) polymers or hydrogenated forms of the polymers.

20 Claims, No Drawings

FUEL COMPOSITION

This is a division of application Ser. No. 225,997, filed July 29, 1988.

FIELD OF THE INVENTION

The present invention relates to novel poly(olefin)-N-substituted-carbamates, their use in preventing deposit formation in engines and to fuel compositions containing these novel poly(olefin)-N-substituted-carbamates.

BACKGROUND OF THE INVENTION

It is known that during the initial operation of a new or clean internal combustion engine, a gradual increase in octane requirement (OR), i.e, the fuel octane number required for knock-free operation, increases with the buildup of combustion chamber deposits until a stable level is reached which generally corresponds to a time when deposits remain relatively constant. The actual stable level can vary with engine design and even with individual engines of the same design.

Many additives are known which can be added to hydrocarbon fuels to attempt to prevent or reduce deposit formation or remove or modify formed deposits in the combustion chamber and adjacent surfaces, such as valves, ports, and spark plugs, in order to reduce octane requirement.

Continued improvement in design of internal combustion engines, e.g., fuel injection and the like, brings changes to the atmosphere of the combustion chamber so there is a continuing need for new additives to control the problem of deposits and improve drivability which is usually related to deposits.

SUMMARY OF THE INVENTION

The present invention is directed to novel poly(olefin)-N-substituted-carbamates, useful for preventing or reducing deposits in engines of the formula I

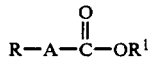

(I)

in which R is a polyolefin polymer chain with an average molecular weight of from about 500 to about 9,900; $R^1$ is a hydrocarbyl or substituted hydrocarbyl group containing of up to 20 carbon atoms; A is an N-substituted amino group in which the substituent is a hydrocarbyl or substituted hydrocarbyl group containing up to 20 carbon atoms.

The novel poly(olefin)-N-substituted-carbamates of the invention are a new class of additives, useful for fuels, e.g., in the gasoline boiling range, for preventing deposits in engines while also readily breaking down cleanly producing very little residue and are miscible with carriers, such as polymeric olefins and the like. Spark plugs from some engines run on some of the fuels containing the novel poly(olefin)-N-substituted-carbamates of the invention are exceptionally clean.

The amine moiety A, of the poly(olefin)-N-substituted carbamates of the invention is derived from an N-substituted monoamine or polyamine, having from 2 to 10 amine nitrogen atoms. The amine moiety can contain up to about 20 carbon atoms. The hydrocarbyl and substituted hydrocarbyl groups of the amine includes aliphatic, alicyclic, aromatic or heterocyclic groups. The substituted hydrocarbyl group includes those hydrocarbyl groups substituted by non-interfering atoms or substituents, including ring oxygen, keto, hydroxy, nitro, cyano, alkoxy, acyl and the like. The hydrocarbyl or substituted hydrocarbyl groups are preferably relatively free of aliphatic unsaturation.

Non-limiting illustrative embodiments of the invention include those of formula I wherein:

| R | $R^1$ | A |
|---|---|---|
| hydrogenated polyisoprene | ethyl | phenyl-N |
| ethylene-propylene copolymer | phenyl | ethyl-N |
| polybutadiene | cyclobutyl | methyl-N |
| polypropylene | benzyl | benzylethyl-N |
| polybutylene | vinyl | isopropyl-N |
| polyisobutylene | methyl | 3-(N,N-dimethyl)aminopropyl-N |
| polyisobutylene | ethyl | 3-(N,N-diethyl)aminopropyl-N |
| polyisobutylene | isobutyl | 2-(N,N-propyl)aminopropyl-N |
| polyisobutylene | ethyl | 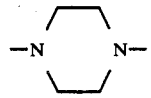 |

The poly(olefin)carbamate compounds of formula I of the invention are conveniently prepared by treating a poly(olefin)-secondary-amine intermediate as described later with a compound of formula IV

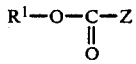

(IV)

in which Z is a halogen, ether, or thioether group and $R^1$ has the above meaning. The hydrocarbyl and substituted hydrocarbyl groups of $R^1$ in formula IV include aliphatic, alicyclic, aromatic or heterocyclic groups. The substituted hydrocarbyl groups include those hydrocarbyl groups substituted by non-interfering atoms or substituents including ring-O, ring-N, keto, hydroxy, nitro, cyano, alkoxy, acyl and the like, the compounds of formula IV are generally available in the art. Suitable, such halides or esters of formula IV include carbonates and thiocarbonates. Preferably, the compounds of formula IV include those compounds wherein $R^1$ is an alkyl group containing from 1 to 10 carbon atoms, an alkenyl group containing from 2 to 7 carbon atoms, a cycloalkyl group containing from 3 to 7 ring carbon atoms and a total of 3 to 10 carbon atoms or an aryl, aralkyl or alkaryl group containing from 6 to 10 total carbon atoms.

1 is an alkyl group containing 1 to 4 carbon atoms, such methyl, ethyl, n-propyl isopropyl, n-butyl, isobutyl or the like. Preferably, $R^1$ is methyl, ethyl, n-butyl or isobutyl. Z is preferably a halogen, such as chlorine.

The reaction to produce the compounds of formula I is usually conducted in a solvent which is non-reactive with chloroformates and which solubilizes the two reactants. Hydrocarbon solvents such as toluene, xylene or the like are suitable.

The reaction is conveniently conducted under relatively moderate conditions. The pressure is readily normal pressure and ambient temperatures of about 0° to about 40° C., e.g., room temperature, are convenient. Other moderate temperatures and pressures can be used which will not decompose the desired product.

The poly(olefin)carbamate product of formula I is recovered by conventional techniques, such as drying by stripping water or by using anhydrous sodium sulfate or the like.

The solvent is usually removed, e.g., by stripping, for neat analysis. However, for practical applications some or all of the solvent can be retained as a diluert.

Small amounts of poly(olefin)-secondary-unreacted amine intermediate need not be removed from the product as the presence thereof does not interfere with the usefulness of the product of formula I. Unreacted amine can aid in the effects of the poly(olefin)-N-substituted-carbamaies of the invention by acting as a carrier, assisting in enhancing the preventing, removing or retarding of engine deposits (particularly when the carbamate is of methyl or a non-beta hydrogen group) or by providing their known fuel detergents properties. Other known materials for use in fuels can also serve one or more of these purposes, including the polymer additives described later.

DESCRIPTION OF THE PREFERRED EMBODIMENT

The preferred novel poly(olefin)-N-substituted-carbamates contain at least one olefinic polymer chain and include those of the formula II

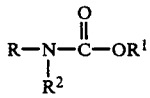

(II)

wherein R is an olefinic polymer chain having an average molecular weight of from about 500 to about 9,900; $R^1$ is hydrocarbyl group containing up to 20 carbon atoms; and $R^2$ is hydrocarbyl group or a hydrocarbylaminohydrocarbyl group, each containing up to 20 total carbon atoms in the hydrocarbyl group(s).

Preferred compounds of formula I of the invention include those compounds wherein R is a poly(olefin) polymer having an average molecular weight of from about 550 to about 4,900; $R^1$ is an alkyl group containing from 1 to 10 carbon atoms, an alkenyl group containing from 2 to 7 carbon atoms, a cycloalkyl group containing from 3 to 7 ring carbon atoms and a total of 3 to 10 carbon atoms or an aryl, aralkyl or alkaryl group containing from 6 to 10 total carbon atoms; and $R^2$ is an alkyl group containing from 1 to 10 carbon atoms, an alkenyl group containing from 2 to 7 carbon atoms, an cycloalkyl group containing from 3 to 7 ring carbon atoms and a total of 3 to 10 carbon atoms or an aryl, aralkyl or alkaryl group containing from 6 to 10 total carbon atoms; or $R^2$ a group of formula III

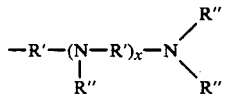

(III)

wherein R′ is an alkylene group containing from 1 to 8 carbon atoms and each R″ is independently a hydrogen atom or an alkyl group containing from 1 to 7 carbon atoms and x is 0 to 5. Preferably, when $R^2$ is a group of formula III, R′ is an alkylene group containing from 1 to 4 carbon atoms; each R″ is independently an alkyl group containing from 1 to 4 carbon atoms and x is 0 to 1, especially R′ is propylene, each R″ is a methyl group and x is 0.

Poly(olefin)-secondary-amine intermediates

The poly(olefin)-secondary-amine intermediates (including polyamines) can be prepared by reacting olefinic polymers with amines employing conventional procedures as hereinafter described.

These oil soluble poly(olefin)-secondary amine intermediates have at least one polymer chain having a molecular weight in the range from about 500 to about 9,900 and preferably from about 550 to about 4,900, and particularly from 600 to 1,300, and which can be saturated or unsaturated and straight or branch chain and are attached to a nitrogen and/or a carbon atom of the amine.

Preferred poly(olefin)-N-substituted-secondary-amine intermediates are polyalkylene polyamines having the structural formula V

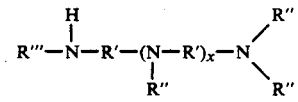

(V)

wherein R‴ is selected from polyolefin having a molecular weight from about 500 to about 9,900, each R′ is an alkylene radical having from 1 to 8 carbon atoms, preferably 1 to 4 carbon atoms, each R″ is hydrogen or lower alkyl containing 1 to 7 carbon atoms and x is 0 to 5. Preferred is a polyalkylere polyamine wherein R‴ is a branch-chain olefin polymer in the molecular weight range of 550 to 4,900, with a molecular weight range of 600–1300 being particularly preferred.

Olefin Polymers Reactants

The olefinic polymers (R in formulas I and II and R‴ in formula V) which are reacted with amines to form the poly(olefin)-N-substituted-secondary-amine intermedates of the present invention are known in the art, such as U.S. Pat. No. 4,357,148, and include olefinic polymers derived from alkanes or alkenes with straight or branched chains, which may or may not have aromatic or cycloaliphatic substituents, for instance, groups derived from polymers or copolymers of olefins which may or may not have a double bond. Examples of non-substitutad alkenyl and alkyl groups are polyethylene groups, polypropylene groups, polybutylene groups, polyisobutylene groups, polyethylene-polypropylene groups, polyethylene-polyalpha-methyl styrene groups and the corresponding groups without double bonds. Particularly preferred are polypropylene and polyisobutylene groups.

The R″ group can be hydrogen but is preferably lower alkyl, i.e., containing up to 7 carbon atcms and more preferably is selected from methyl, ethyl, propyl, butyl and the like.

Amine Reactants

Suitable amine reactants are broadly referred to as (poly)amines to include both polyamines and monoamines as hereinafter more fully described. The (polyl) amines used to react with the polyolefins to form the poly(olafin)-N-substituted-secondary-amine intermediates include aliphatic, alicyclic, aromatic or heterocyclic monoamines or polyamines. A variety of such amines is well documented in the art including U.S. Pat.

No. 4,191,537, incorporated by reference. The amines can contain other non-reactive substitutes. Suitable substitutents for such amines include alkyls such as methyl, ethyl, propyl, butyl, isobutyl, pentyl, hexyl, octyl, and the like; alkenyls such as propenyl, isobutenyl, hexenyl, octenyl and the like; hydroxyalkyls, such as 2-hydroxyethyl, 3-hydroxypropyl, hydroxyisopropyl, 4-hydroxybutyl, etc.; ketoalkyls, such as 2-ketopropyl, 6-ketooctyl, and the like; alkoxy and lower alkenoxyalkyls, such as ethoxyethyl, ethoxypropyl, propoxyethyl, propoxypropyl, 2-(2-ethoxyethoxy)ethyl, and acyl groups such as propionyl, acetyl, and the like. Preferred substituents are $C_1$–$C_6$ alkyls.

Heterocyclic amines can be saturated, unsaturated and substituted or unsubstituted. Suitable heterocyclic amines include piperazines, such as 2-methylpiperazine, N-(2-hydroxyethyl)piperzaine, 1,2-bis-(N-piperazinyl)ethane, and N,N'-bis(N-piperazinyl)piperazine, 2-methylimidazoline, 3-aminopiperidine, 2-aminopyridine, 2-(3-aminoethyl)-3-pyrroline, 3-aminopyrroidine, N-(3-aminopropyl)morpholine, and the like. Among the heterocyclic compounds, the piperazines are preferred.

The amine reactants include mixtures of compounds, such as mono and polysubstituted polyamines or isomers.

The polyamines used to form the preferred poly(olefin) polyamine intermediate compounds of this invention include low molecular weight aliphatic polyamines such as ethylene diamine, diethylene triamine, triethylene tetramine, propylene diamine, butylene diamine, trimethyl triaethylene diamine, tetramethylene diamine, diaminopentane or pentamethylene diamine, hexamethylene diamine, heptamethylene diamine, diaminooctane, decamethylene diamine, and higher homologues up to 18 carbon atoms.

Compounds possessing triamine as well as tetramine and pentamine groups are applicable for use because these can be prepared from technical mixtures of polyethylene polyamines, which offer economic advantages.

The polyamine starting materials from which the polyamine groups can be derived can also be a cyclic polyamine, for instance, the cyclic polyamines formed when aliphatic polyamines with nitrogen atoms separated by ethylene groups were heated in the presence of hydrogen chloride.

Monoamines which can be used to prepare the poly(olefin)-secondary-amines include monoamines in which the hydrocarbyl groups contains from 1 to 14 carbon atoms. For example, each hydrocarbyl groups are independently selected from an alkyl group containing from 1 to 10 carbon atoms, an alkenyl group containing from 2 to 7 carbon atoms, a cycloalkyl group containing from 3 to 7 ring carbon atoms and a total of 3 to 10 carbon atoms or an aryl, aralkyl, or alkaryl group containing from 6 to 10 total carbon atoms. Preferably, the hydrocarbyl groups are independently selected from an alkyl group containing from 1 to 4 carbon atoms, e.g., ethyl, propyl or the like.

An example of a suitable process for the preparation of the poly(olefin)amine compounds employed according to the invention is the reaction of a halogenated hydrocarbon having at least one halogen atom as a substituent and a hydrocarbon chain as defined hereinbefore with a (poly)amine. The halogen atoms are replaced by a (poly)amine group, while hydrogen halide is formed. The hydrogen halide can then be removed in any suitable way, for instance, as a salt with excess (poly)amine. The reaction between halogenated hydrocarbon and (poly)amine is preferably effected at elevated temperature in the presence of a solvent; particularly a solvent having a boiling point of at least 160° C.

The reaction between polyhydrocarbon halide and a (poly)amine having more than one nitrogen atom available for this reaction is preferably effected in such a way that cross-linking is reduced to a minimum, for instance, by applying an excess of (poly)amine.

The (poly)amine reactants according to the invention can be prepared, for instance, by alkylation of low molecular weight aliphatic (poly)amines. For instance, a (poly)amine is reacted with an alkyl or alkenyl halide. The formation of the alkylated (poly)amine is accompanied by the formation of hydrogen halide, which is removed, for instance, as a salt of starting (poly)amine present in excess. With this reaction between alkyl or alkenyl halide and the strongly basic (poly)amines, dehalogenation of the alkyl or alkenyl halide may occur as a side reaction, so that hydrocarbons are formed as by-products, which need not be removed.

Fuel Compositions

Suitable liquid hydrocarbon fuels of the gasoline boiling range are mixtures of hydrocarbons having a boiling range of from about 25° C. (77° F.) to about 232° C. (450° F.), and comprise mixtures of saturated hydrocarbons, olefinic hydrocarbons and aromatic hydrocarbons. Preferred are gasoline blends having a saturated hydrocarbon content ranging from about 40 to about 80 percent volume, an olefinic hydrocarbon content from about 0 to about 30 percent volume and an aromatic hydrocarbon content ranging from about 10 to about 60 percent volume. The base fuel can be derived from straight run gasoline, polymer gasoline, natural gasoline, dimer and trimerized olefins, synthetically produced aromatic hydrocarbon mixtures, from thermally or catalytically reformed hydrocarbons, or from catalytically cracked or thermally cracked petroleum stocks, and mixtures of these. The hydrocarbon composition and octane level of the base fuel are not critical. Any conventional motor fuel base can be employed in the practice of this invention.

Normally, the hydrocarbon fuel mixtures to which the invention is applied are substantially lead-free, but may contain minor amounts of blending agents such as methanol, ethanol, ethyl tertiary butyl ether and the like. The fuels can also contain antiknock compounds such as tetraethyl lead, a methyl cyclopentadienylmanganese tricarbonyl, ortho-azidophenol and the like.

An effective amount poly(olefin)-N-substituted carbamates of the present invention can be introduced into the combustion zone of the engine in a variety of ways to prevent buildup of deposits, or to accomplish reduction or modification of deposits. Thus, the poly(olefin)-carbamates can be injected into the intake manifold intermittently or substantially continuously, as described, preferably in a hydrocarbon carrier having a final boiling point (by ASTM D86) lower than about 232° C. (450° F.). A preferred method is to add the agent to the fuel. For example, the agent can be added separately to the fuel or blended with other fuel additives. The effective amount of poly(olefin)-N-substituted carbamates of the invention used will of course depend on the particular compound(s) used, the engine and the fuel and carrier types. For example, the poly(olefin)-N-substituted carbamates can be used in an amount of from about 20 to about 750 ppm weight based on the total weight of the fuel composition and preferably from about 40 to about 500 ppm by weight.

For use in the fuel compositions of the invention, mixtures of different poly(olefin)-N-substituted-carbamates can be used. For example, a mixture where $R^1$ in formula I is methyl and is isobutyl. Alternatively, the A or the R could be mixtures of different groups in formula I.

The poly(olefin)-N-substituted carbamate of the invention can also be used in combination with certain polymeric components which are polymers of monoolefins having up to 6 carbon atoms; poly (oxyalkylene) alcohols, glycols or polyols; or polyolefin amines. Such materials are well known in the art. For example, polymers of monoolefins are including U.S. Pat. Nos. 2,692,257, 2,692,258, 2,692,259, 2,918,508, and 2,970,179 and their disclosures are incorporated herein by references.

Such polymers include (1) polymers of $C_2$ to $C_6$ monoolefins, (2) copolymers of $C_2$ to $C_6$ monoolefins, (3) the corresponding hydrogenated polymer (1) or copolymer (2) or (4) mixtures of at least two of (1), (2), (3) and (4), and polymeric component having an average molecular weight by osmometry in the range of from about 500 to about 3500, preferably about 500 to about 1500. Particularly preferred are those having said average molecular weight in the range from about 600 to about 950. Mixtures of polymers wherein a substantial portion of the mixture has a molecular weight above 1500 are considerably less effective. The polyolefins may be prepared from unsaturated hydrocarbons having from 2 to 6 carbon atoms including, e.g., ethylene, propylene, butylene, isobutylene, butadiene, amylene, isoprene, and hexene.

Preferred for their efficiency and commercial availability are polymers of propylene and butylene; particularly preferred are polymers of polyisobutylene. Also suitable and part of this invention are derivatives resulting after hydrogenation of the above polymers.

Poly(-$C_2$ to $C_6$-oxyalkylene) alcohols, glycols and polyol carriers can be used singly or in mixtures, such as the Pluronics marketed by BASF Wyandotte Corp., and the UCON LB-series fluids marketed by Union Carbide Corp. Preferably, these carriers include poly(oxypropylene) alcohol, glycol or polyol of molecular weight of about 300 to about 4000, which may or may not be capped by an alkyl group, e.g., a ($C_{1-10}$ hydrocarbyl)poly(oxypropylene) alcohol and polyethylene glycols of molecular weight of from about 300 to 4000.

The poly(olefin) amines of a $C_2$ to $C_6$ monoolefin, described hereinbefore for use as the starting materials used to make the compounds of formula I are also useful as the poly(olefin) amine fuel additives.

The invention further provides a concentrate for use in liquid (hydrocarbon) fuel in the gasoline boiling range comprising (a) from about 25 to about 500 ppm by weight (preferred from about 50 to about 200 ppm) of the hereinabove described poly(olefin)-N-substituted carbamate of the invention; (b) at least one from about 10 to about 1000 ppm (preferably 50–400 ppm) by weight of a polymeric component which is (i) a polymer of a $C_2$ to $C_6$ monoolefin, (ii) a copolymer of a $C_2$ to $C_6$ monoolefin, (iii) the corresponding hydrogenated polymer or copolymer, (iiii) a poly(oxy-$C_2$ to $C_6$-alkylene) alcohol, glycol or L- polyol, (V) a poly(olefin)amine of a $C_2$ to $C_6$ monolefin or mixtures of at least two of (i), (ii), (iii) (IV) and (V), (c) optionally from about 0 to about 20 ppm by weight of a dehazer and (d) balance a diluent, boiling in the range from about 50° C. (122° F.) to about 232° C. (450° F.). Very suitable diluents include oxygen-containing hydrocarbons and non-oxygen-containing hydrocarbons. Suitable oxygen-containing hydrocarbon solvents include, e.g., methanol, ethanol, propanol, methyl tert-butyl ether and ethylene glycol monobutyl ether. The solvent can be an alkane such as heptane, but preferably is an aromatic hydrocarbon solvent such as toluene, xylene alone or in admixture with said oxygen-containing hydrocarbon solvents. Optionally, the concentrate can contain from about 0 to about 20 ppm by weight of a dehazer, particularly a polyester-type ethoxylated alkylphenol-formaldehyde resin, or other conventional dehazer.

The invention further provides a method for operating a spark ignition internal combustion engine (ICE) which comprises introducing with the combustion intake fuel charge to said engine a deposit preventing or reducing effective amount of at least one poly(olefin)-N-substituted carbamate of formula I in which the poly(olefin) polymer chain has an average molecular weight of from about 500 to about 9,900 and the substituent on the nitrogen atom is a hydrocarbyl group or a hydrocarbylaminohydrocarbyl group, each containing up to 20 total carbon atoms in the hydrocarbyl group(s).

The preferences expressed earlier with regard to (a) the poly(olefin)-N-substituted carbamates of formula I and/or (b) the polymeric component or other additives also apply to the concentrate, motor fuel composition and method of operating the ICE.

Illustrative Embodiments

The invention will now be illustrated with reference to the following examples which should not be regarded as limiting the invention in any way.

EXAMPLE 1

Preparation of a Compound of Formula I with $R^1$=n-butyl; R=polyisobutylene of 900 average molecular weight; and A=N—$CH_2CH_2CH_2NMe_2$ Five Hundred grams of polyisobutylene-NH—$(CH_2)_3$—$NMe_2$ (80.5% non-volatile, 19.5% xylenes, and containing 1.50% basic nitrogen) were charged to a 1000 ml, round-bottomed flask equipped with an air-driven stirrer, reflux condenser, thermometer, and addition funnel. To the addition funnel were added 45.5 grams of n-butyl chloroformate and 21 ml of toluene. The toluene solution was added dropwise at room temperature to the round-bottomed flash with stirring. The addition took about 10 minutes with an increase of 36° C. in reaction temperature. The reaction flask was heated to 160° C. after the addition was completed and maintained at that temperature for 1 hour. The addition funnel was removed and replaced with a powder funnel. Through this latter funnel was added a solution of 44.3 grams of sodium carbonate in 177 grams of water. Upon completion of the addition, the flask was heated to 100° C. for one hour.

The contents of the reaction flask were transferred to a 2000 ml separatory funnel where the layers were separated and the lower water layer was removed. The remaining layer was treated three times with 150 ml of water. The water was removed and the contents of the funnel were transferred to a 2000 ml Erlenmeyer flask. Five hundred ml of toluene and 20 scoopulas of anhydrous sodium sulfate were added to the flask. After one hour of stirring, the contents of the Erlenmeyer flask were filtered and solvent removed by rotary evaporation. Evaluation of the neat material revealed a basic nitrogen content of 0.82% w and a total nitrogen of 1.71% w confirming that one of the two nitrogens had reacted and was now rendered non-basic. Examination by IR showed a typical carbamate absorption at 1700 $cm^{-1}$ (uncorrected).

EXAMPLE 2

A series of other compounds of formula I of the invention were made similar to the procedures described in Example I and these compounds are set forth in Table 1 below.

TABLE 1

| $R^1$ | $N_t$[a], % w | $N_b$[b], % w | IR, $cm^{-1}$ |
|---|---|---|---|
| Methyl | 1.87 | 1.09 | 1720 |
| Ethyl | 1.80 | 0.93 | 1715 |
| n-Butyl | 1.71 | 0.82 | 1700 |
| i-Butyl | 1.73 | 0.76 | 1715 |
| n-Octyl | 1.68 | 0.83 | 1710 |

[a] $N_t$ = Total nitrogen
[b] $N_b$ = Basic nitrogen

EXAMPLE 3

Engine Tests

Fuels shown in Table 2 were tested in a 1983 Chevorlet 2.0 litre and a 1987 Ford 3.0 litre V-6 engine with Port Fuel Injection (PFI) to determine the effectiveness of the poly(olefin)-N-substituted-carbamates of the invention on induction system cleanliness, fuel economy and deposit de-adhesion.

The base fuel comprised premium unleaded gasoline. The poly(olefin)-N-substituted-carbamates were those prepared in Experiment I above. Poly(olefin) carrier fluid was added in some tests.

Each engine was in clean condition at the start of the test, i.e., oil and filters were changed and all deposits had been removed from the intake manifolds, intake ports and combustion areas of the engine. In order to test for the accumulation of deposits in the engine during each test, the engines were operated on a cycle consisting of idle mode and cruising modes of 30, 35, 45, 55 and 65 miles an hour with accelerations and decelerations. The tests were conducted for 100 hours and then the valves and port deposits were visually rated on a scale of 1 to 10, in which "10" is essentially free of deposit by comparison to representative photographs of values having ratings of 10, 9, 8, etc. The weight of the value deposits was also measured. Results of these tests are set forth in Table 2 below.

TABLE 2

| Engine | $R^1$ of Carbamate Additive | Carrier | Additive/Carrier Conc. ppm | Average Valve Deposit Wt., mg | Valves CRC[c] | Ports CRC |
|---|---|---|---|---|---|---|
| | Engine Tests - Intake Valve Ratings and Weights[a] | | | | | |
| 1983 Chevrolet | Base[b] | — | — | 681 | 7.0 | 6.3 |
| 2.0 L, I-4, TBI | Ethyl | — | 200/0 | 361 | 7.5 | 8.1 |
| 1987 Ford | Base[b] | — | — | 173 | 8.2 | 8.1 |
| 3.0 L, V-6, PFI | Isobutyl | — | 200/0 | 69 | 9.1 | 8.6 |
| | Ethyl | — | 200/0 | 22 | 9.2 | 9.2 |
| | Methyl | — | 200/0 | 2 | 9.7 | 9.5 |
| | Ethyl | PIB[d] | 50/400 | 107 | 8.8 | 9.0 |
| | Ethyl | PIB | 150/100 | 97 | 8.9 | 8.3 |
| | Ethyl | PIB | 50/250 | 72 | 9.1 | 8.5 |
| | Isobutyl | PIB | 50/400 | 103 | 9.2 | 9.2 |

[a] One hundred hours clean tests.
[b] Premium unleaded gasoline.
[c] CRC means Coordinating Research Council of the API (American Petroleum Institute)
[d] Polyisobutylene average molecular weight of about 730.

Results of these tests demonstrate that the poly(olefin)-N-substituted-carbamates of the invention are very useful in very significantly preventing the accumulation of deposits in the engines tested as compared to the effects of the base fuel as shown by the much lower average valve deposits and the higher average visual rating fo valve and port deposits. The use of polyisobutylene as a carrier fluid also results in preventing the accumulation of deposits.

What is claimed is:

1. A compound comprising a poly(olefin)-N-substituted-carbamate of formula I $$R-A-\overset{\overset{\displaystyle O}{\|}}{C}-OR^1 \qquad (I)$$

in which R is a poly(olefin) chain having an average molecular weight of from about 500 to about 9,900; $R^1$ is a hydrocarbyl or substituted hydrocarbyl group containing up to 20 carbon atoms; and A is derived from an N-substituted amino group in which the substituent is a hydrocarbyl or substituted hydrocarbyl group containing up to 20 carbon atoms.

2. A compound according to claim 1 of the formula II $$R-\underset{\underset{\displaystyle R^2}{|}}{N}-\overset{\overset{\displaystyle O}{\|}}{C}-OR^1 \qquad (II)$$

wherein R is a poly(olefin) having an average molecular weight of from about 500 to about 9,900; $R^1$ is a hydrocarbyl group containing up to 20 carbon atoms and $R^2$ is a hydrocarbyl or hydrocarbylaminohydrocarbyl group, each containing up to 20 total carbon atoms in the hydrocarbyl group(s).

3. A compound according to claim 2 wherein R is a poly(olefin) having an average molecular weight of from about 550 to about 4,900.

4. A compound according to claim 3 wherein the poly(olefin) has an average molecular weight of from about 600 to about 1,300.

5. A compound according to claim 4 wherein R is a polyisobutylene group.

6. A compound according to claim 2 wherein $R^2$ is an alkyl group containing from 1 to 10 carbon atoms, an alkenyl group containing from 2 to 7 carbon atoms, a cycloalkyl group containing from 3 to 7 ring carbon atoms and a total of 3 to 10 carbon atoms or an aryl, aralkyl or alkaryl group containing from 6 to 10 total carbon atoms.

7. A compound according to claim 2 wherein $R^2$ is a group of Formula III

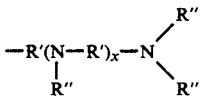

(III)

wherein each R′ is independently an alkylene radical containing from 1 to 8 carbon atoms, each R″ is independently a hydrogen atom or an alkyl group containing from 1 to 7 carbon atoms and x is 0 to 5.

8. A compound according to claim 6 wherein each R′ is independently an alkylene containing from 1 to 4 carbon atoms, each R″ is independently an alkyl group containing from 1 to 4 carbon atoms and x is 0 to 2.

9. A compound according to claim 8 wherein R′ is propylene, each R″ is a methyl group and x is 0.

10. A compound according to claim 2 wherein $R^1$ is an alkyl group containing from 1 to 10 carbon atoms, an alkenyl group containing from 2 to 7 carbon atoms, a cycloalkyl group containing from 3 to 7 ring carbon atoms and a total of 3 to 10 carbon atoms or an aryl, aralkyl or alkaryl group containing from 6 to 10 total carbon atoms.

11. A compound according to claim 10 wherein $R^1$ is an alkyl group containing 1 to 4 carbon atoms.

12. A compound according to claim 11 wherein R is a poly(olefin) having an average molecular weight of from about 600 to about 1,300.

13. A compound according to claim 12 wherein $R^2$ is a group of Formula III

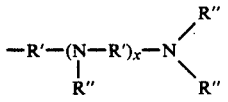

(III)

wherein each R′ is independently an alkylene radical containing from 1 to 8 carbon atoms, each R″ is independently a hydrogen atom or an alkyl group containing from 1 to 7 carbon atoms and x is 0 to 5.

14. A compound according to claim 13 wherein R is a polyisobutylene group.

15. A compound according to claim 14 wherein each R′ is independently an alkylene group containing from 1 to 4 carbon atoms, each R″ is independently an alkyl group containing from 1 to 4 carbon atoms and x is 0 to 2.

16. A compound according to claim 4 wherein R′ is propylene, each R″ is a methyl group and x is 0.

17. A compound according to claim 16 wherein $R^1$ is a methyl group.

18. A compound according to claim 16 wherein $R^1$ is an ethyl group.

19. A compound according to claim 16 wherein $R^1$ is an n-butyl group.

20. A compound according to claim 16 wherein $R^1$ is an isobutyl group.

* * * * *